US010525319B1

(12) United States Patent
Sabo

(10) Patent No.: US 10,525,319 B1
(45) Date of Patent: Jan. 7, 2020

(54) ILLUMINATED BEER PONG ASSEMBLY

(71) Applicant: Joseph Sabo, Bechtelsville, PA (US)

(72) Inventor: Joseph Sabo, Bechtelsville, PA (US)

( * ) Notice: Subject to any disclaimer, the term of this patent is extended or adjusted under 35 U.S.C. 154(b) by 0 days.

(21) Appl. No.: 16/182,043

(22) Filed: Nov. 6, 2018

(51) Int. Cl.

| | |
|---|---|
| ***A63B 67/00*** | (2006.01) |
| ***A63B 67/06*** | (2006.01) |
| ***A63B 63/08*** | (2006.01) |
| *A63F 7/00* | (2006.01) |

(52) U.S. Cl.
CPC ..... *A63B 67/002* (2013.01); *A63B 63/08* (2013.01); *A63B 67/06* (2013.01); *A63B 2207/02* (2013.01); *A63B 2225/093* (2013.01); *A63F 7/0017* (2013.01); *A63F 2250/024* (2013.01); *A63F 2250/426* (2013.01)

(58) Field of Classification Search
CPC ..... A63B 67/002; A63B 67/06; A63B 63/08; A63B 7/0017; A63B 2207/02; A63B 2225/073; A63B 2250/024; A63B 2250/426
See application file for complete search history.

(56) References Cited

U.S. PATENT DOCUMENTS

| | | | | |
|---|---|---|---|---|
| 3,450,406 | A * | 6/1969 | Brown | A63D 5/00 473/83 |
| 7,237,777 | B2 * | 7/2007 | Digges, III | A63B 67/06 273/400 |
| 7,805,959 | B2 | 10/2010 | Webb | |
| 8,006,980 | B1 * | 8/2011 | Herro | A63B 63/08 273/342 |
| 8,662,501 | B1 | 3/2014 | Perales | |
| 8,905,406 | B2 | 12/2014 | Brown | |
| D743,491 | S | 11/2015 | Fissell | |
| 9,643,067 | B2 | 5/2017 | Snyder | |
| 9,687,708 | B2 * | 6/2017 | Bennett | A63B 67/06 |
| D836,726 | S * | 12/2018 | Wasserman | D21/397 |
| 2005/0029747 | A1 | 2/2005 | Grayson | |
| 2012/0225742 | A1 * | 9/2012 | Max | A63B 63/08 473/481 |
| 2012/0256378 | A1 * | 10/2012 | Brown | A63B 63/08 273/401 |
| 2013/0069311 | A1 * | 3/2013 | Pryor | A63B 63/00 273/342 |
| 2014/0027983 | A1 | 1/2014 | Keebler | |
| 2014/0151964 | A1 * | 6/2014 | Alway | A63B 63/08 273/371 |
| 2014/0265136 | A1 * | 9/2014 | Parker | A63B 63/00 273/398 |

(Continued)

FOREIGN PATENT DOCUMENTS

| | | |
|---|---|---|
| WO | WO2011105983 | 9/2011 |

*Primary Examiner* — Raleigh W Chiu

(57) ABSTRACT

An illuminated beer pong assembly includes a tripod, a box that is pivotally coupled to the tripod and a lid that is hingedly coupled to the box. The lid has a plurality of cup openings to receive a respective beverage cup. A plurality of game light emitters is each positioned within the box and is aligned with a respective one of the cup openings in the lid for illuminating the respective beverage cup. At least one ball, comprised of a phosphorescent material, is thrown toward a selectable one of the cup openings for playing the game of beer pong. A plurality of radiation emitters is each coupled to the box and charges the at least one ball thereby facilitating the at least one ball to glow in the dark.

5 Claims, 6 Drawing Sheets

(56) References Cited

U.S. PATENT DOCUMENTS

| | | | | |
|---|---|---|---|---|
| 2015/0335971 | A1* | 11/2015 | Fissell | A63B 67/06<br>273/407 |
| 2015/0335972 | A1* | 11/2015 | Fissell | A63B 67/06<br>273/407 |
| 2016/0082333 | A1* | 3/2016 | Tappin | A63B 67/002<br>273/400 |
| 2016/0107078 | A1* | 4/2016 | Lattin | A63F 9/0208<br>273/348.3 |
| 2019/0232136 | A1* | 8/2019 | Krause | A63B 63/08 |

* cited by examiner

FIG. 5
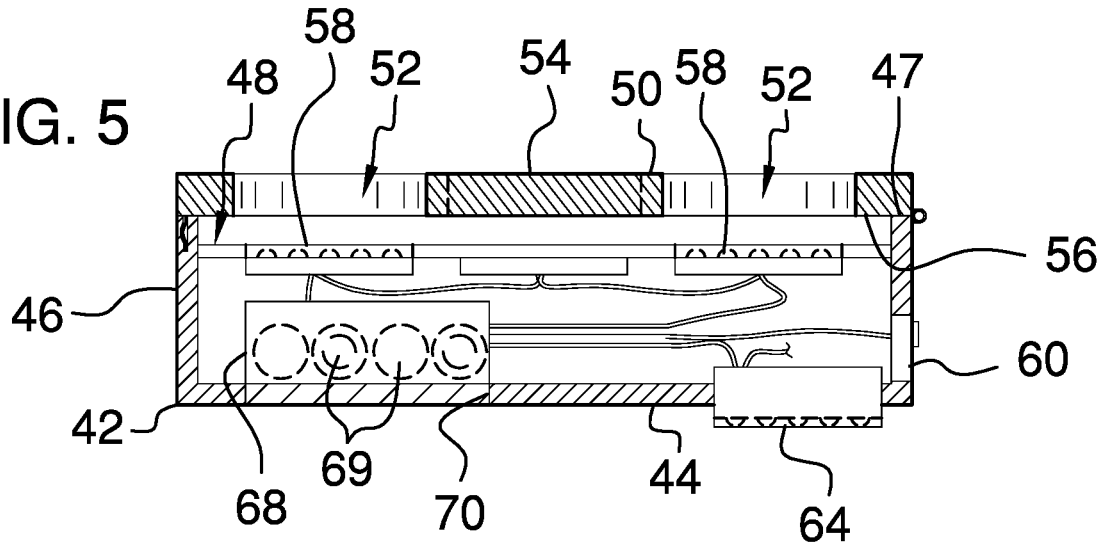
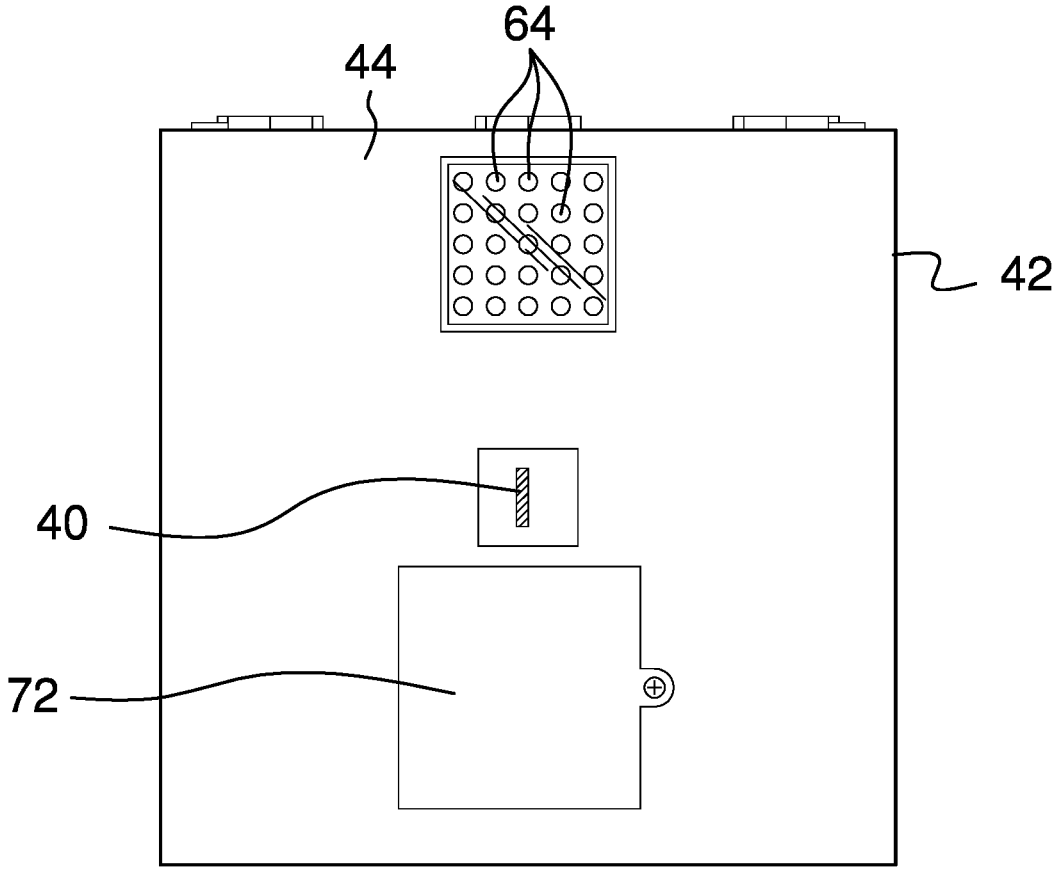
FIG. 6

ILLUMINATED BEER PONG ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to beer pong devices and more particularly pertains to a new beer pong device for facilitating beer pong to be played in a darkened environment.

BRIEF SUMMARY OF THE INVENTION

An embodiment of the disclosure meets the needs presented above by generally comprising a tripod, a box that is pivotally coupled to the tripod and a lid that is hingedly coupled to the box. The lid has a plurality of cup openings to receive a respective beverage cup. A plurality of game light emitters is each positioned within the box and is aligned with a respective one of the cup openings in the lid for illuminating the respective beverage cup. At least one ball, comprised of a phosphorescent material, is thrown toward a selectable one of the cup openings for playing the game of beer pong. A plurality of radiation emitters is each coupled to the box and charges the at least one ball thereby facilitating the at least one ball to glow in the dark.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 5 is a cross sectional view taken along line 5-5 of FIG. 4 of an embodiment of the disclosure.

FIG. 6 is a bottom view of a box of an embodiment of the disclosure.

DETAILED DESCRIPTION OF THE INVENTION

Figure 1:
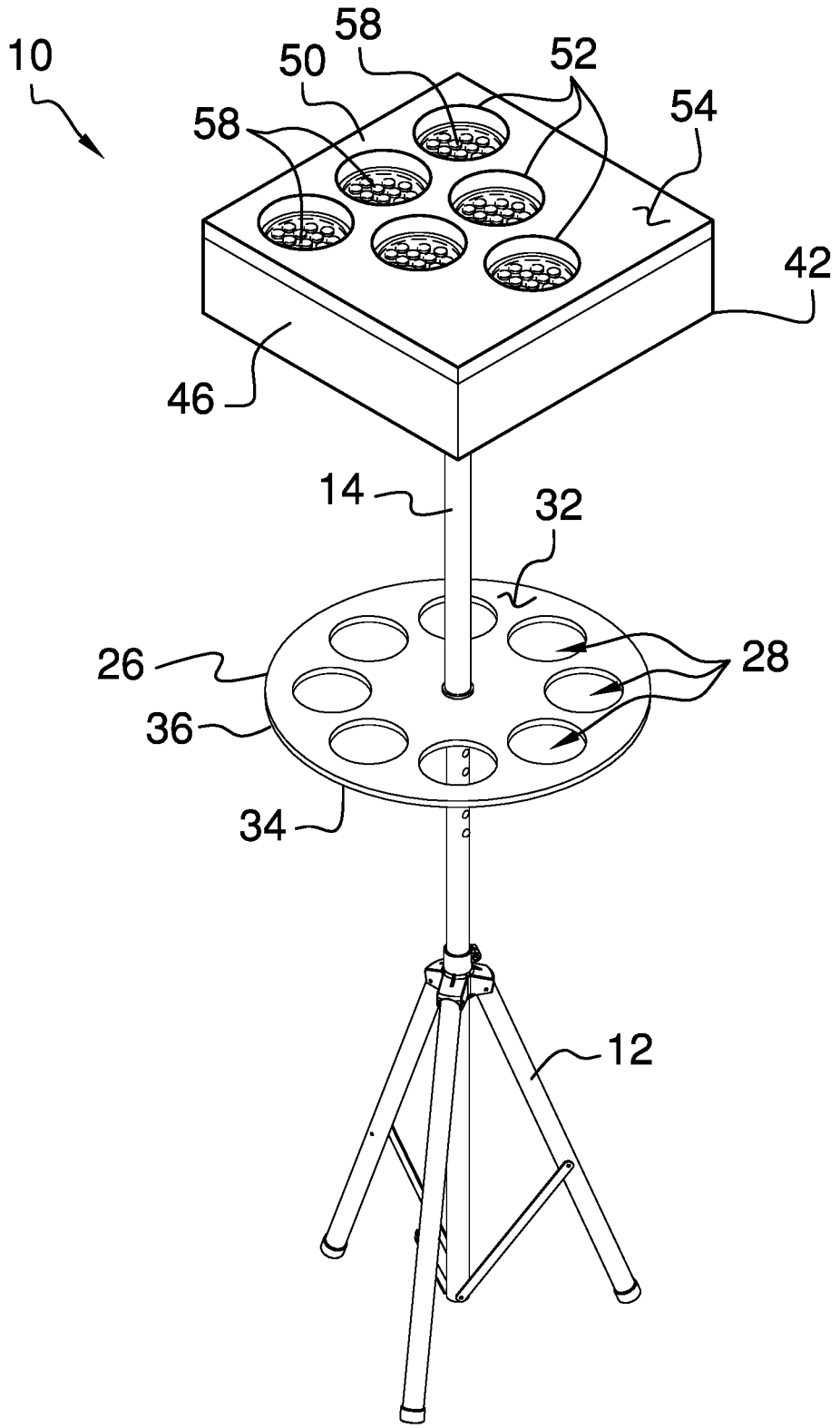
FIG. 1 is a top perspective view of an illuminated beer pong assembly according to an embodiment of the disclosure.
Figure 2:
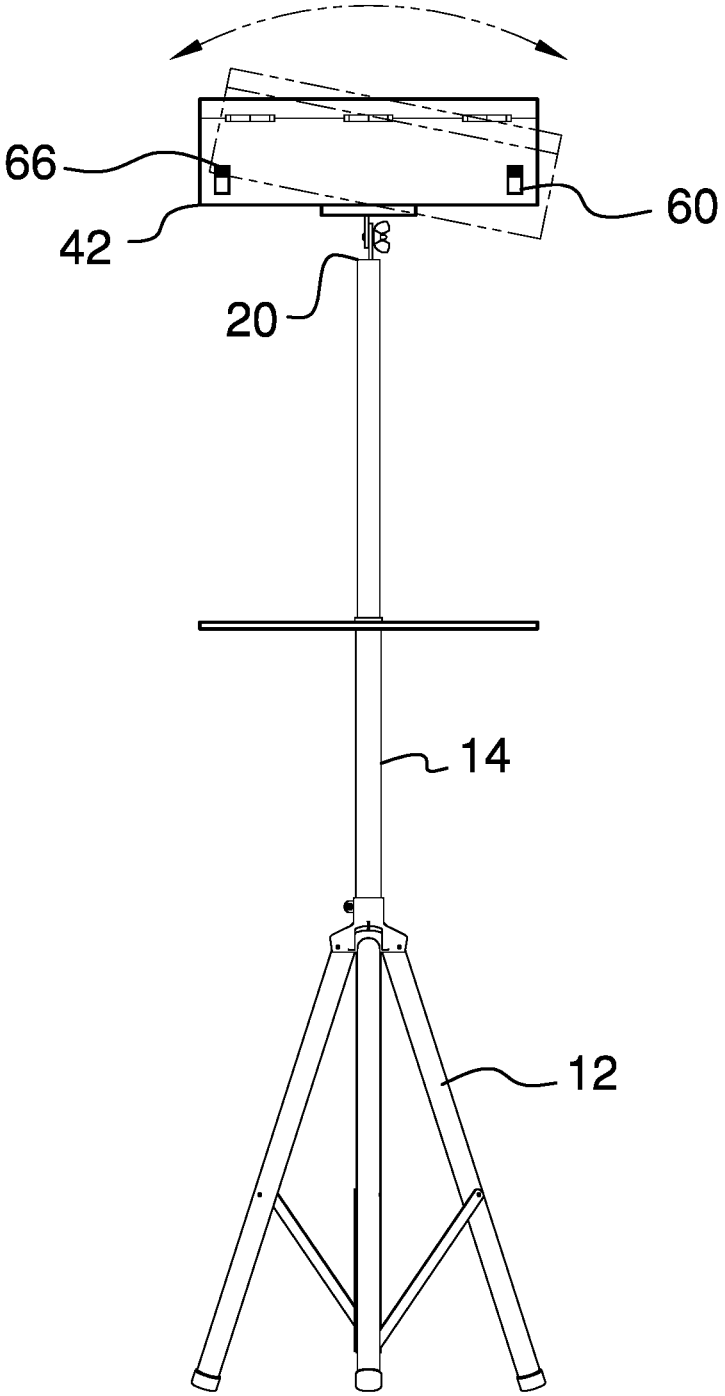
FIG. 2 is a front view of an embodiment of the disclosure.
Figure 3:
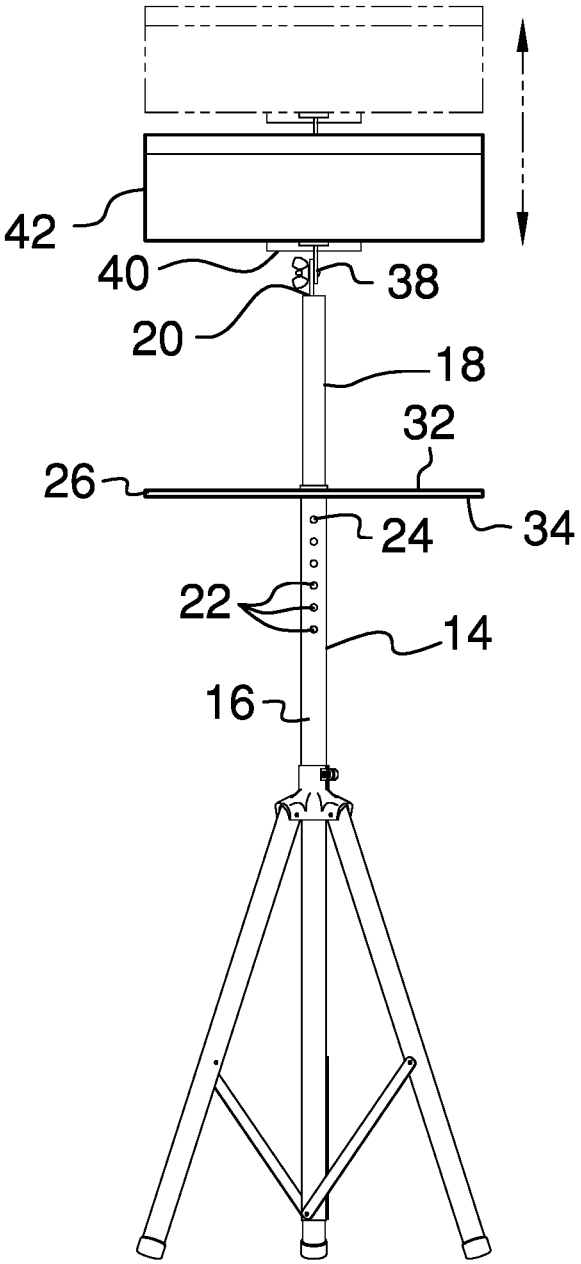
FIG. 3 is a back view of an embodiment of the disclosure.
Figure 4:
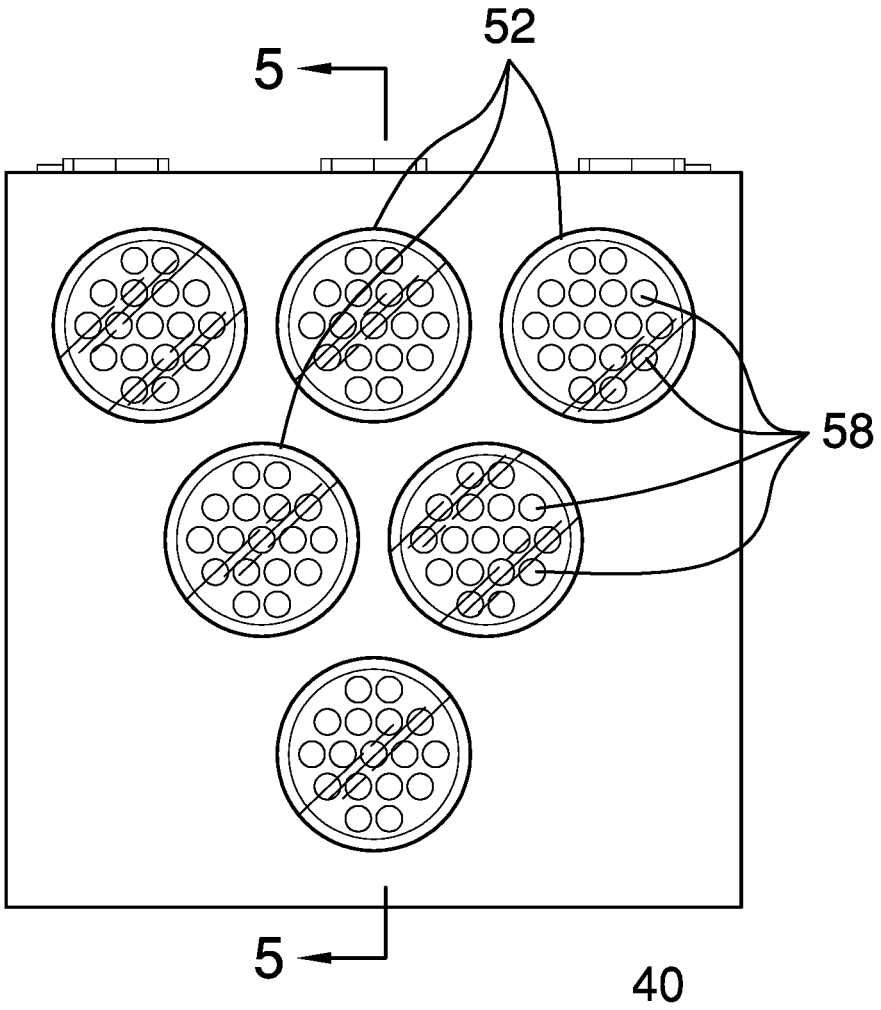
FIG. 4 is a top view of an embodiment of the disclosure.
Figure 7:
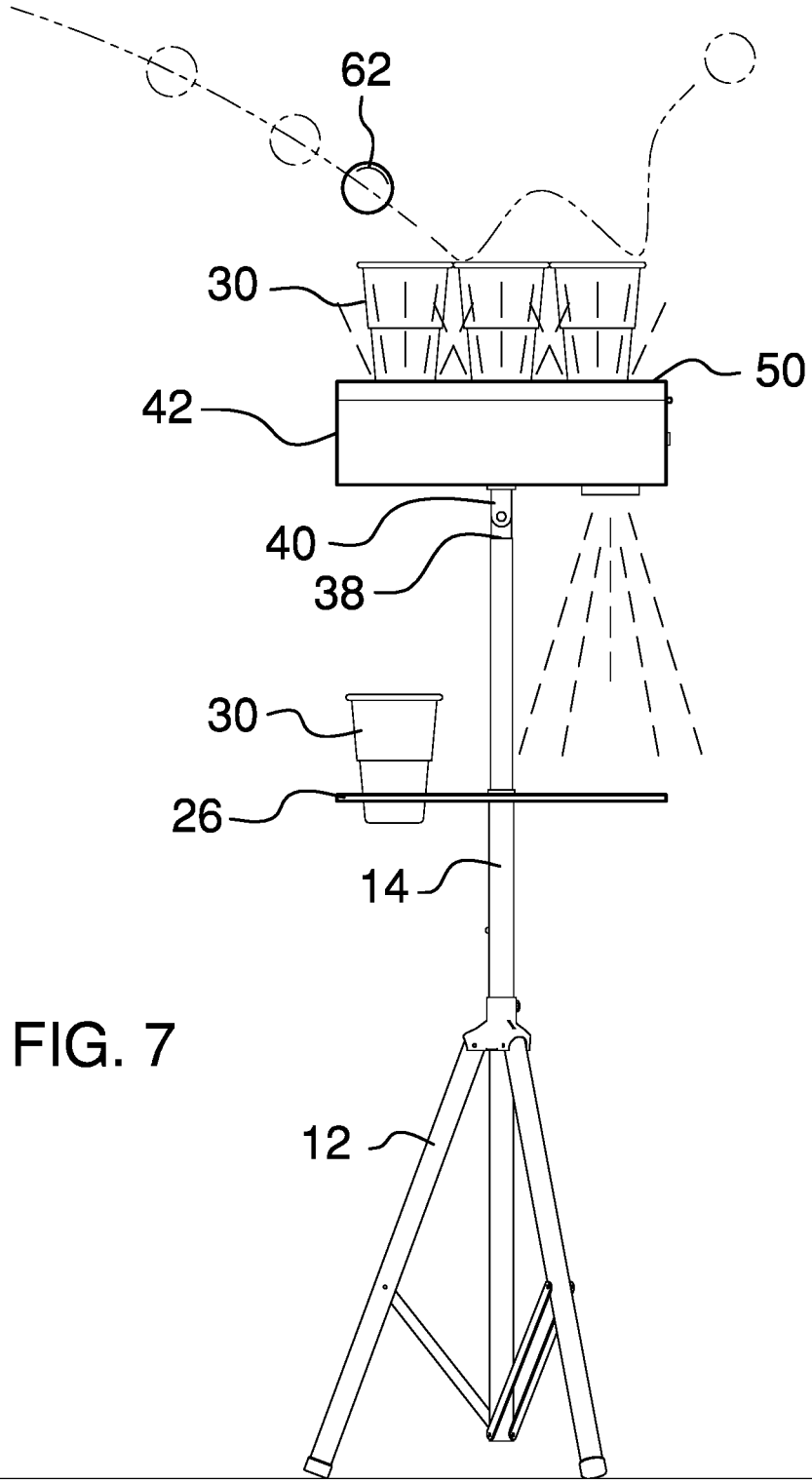
FIG. 7 is a perspective in-use view of an embodiment of the disclosure.

With reference now to the drawings, and in particular to FIGS. 1 through 7 thereof, a new beer pong device embodying the principles and concepts of an embodiment of the disclosure and generally designated by the reference numeral 10 will be described.

As best illustrated in FIGS. 1 through 7, the illuminated beer pong assembly 10 generally comprises a tripod 12 that is positionable between a deployed position and a stored position. The tripod 12 includes a shaft 14 that is vertically oriented when the tripod 12 is positioned in the deployed position. The shaft 14 has a first section 16 that is slidably coupled to a second section 18 such that the shaft 14 has a telescopically adjustable height, and the second section 18 has a distal end 20 with respect to the tripod 12. The first section 16 may have a plurality of openings 22 being vertically distributed thereon and a lock 24 may be movably coupled to the second section 18. The lock 24 may releasably engage a selectable one of the openings 22 in the first section 16 for retaining the shaft 14 at a selected height.

A disk 26 is included and the shaft 14 extending through the disk 26. The disk 26 has a plurality of openings 28 extending therethrough for receiving, and thusly storing, a respective beverage cup 30. The disk 26 has a first surface 32, a second surface 34 and a peripheral edge 36 extending therebetween. Each of the openings 28 in the disk 26 extends through the first 32 and second 34 surfaces, and the openings 28 are spaced from the peripheral edge 36 and are distributed around the peripheral edge 36. Additionally, the shaft 14 extends through a center of the first 32 and second 34 surfaces, and the disk 26 is positioned on the first section 16 of the shaft 14.

A pivot 38 is provided and the pivot 38 is coupled to the distal end 20 of the second section 18 of the shaft 14. The pivot 38 includes a coupling 40 that is rotatable about a horizontal axis. A box 42 is pivotally coupled to the shaft 14 and the box 42 is spaceable a selected distance above the tripod 12 when the tripod 12 is positioned in the deployed position. Thus, the box 42 can be elevated to a predetermined height ranging between approximately 2.0 feet and 6.0 feet. The box 42 has a bottom wall 44 and an outer wall 46 extending upwardly therefrom, and the outer wall 46 has a distal edge 47 defining an opening 48 into the box 42. The bottom wall 44 is coupled to the coupling 40 of the pivot 38 such that the box 42 is tiltable about the horizontal axis. Thus, the box 42 can be adjusted to be level when the tripod 12 is positioned on unlevel ground.

A lid 50 is provided and the lid 50 is hingedly coupled to the box 42. The lid 50 has a plurality of cup openings 52 each extending therethrough to receive a respective beverage cup 30. The respective beverage cup 30 may be a clear, plastic beer cup of other type of translucent cup. The cup openings 52 are arranged into a triangular shape thereby arranging the beverage cups 30 into the preferred positioning for the game of beer pong. The lid 50 has top surface 54 and a bottom surface 56, and each of the cup openings 52 extends through the top 54 and bottom 56 surfaces. The bottom surface 56 of the lid 50 abuts the distal edge 47 of the outer wall 46 of the box 42 when the lid 50 is closed.

A plurality of game light emitters 58 is each positioned within the box 42 and each of the game light emitters 58 is aligned with a respective one of the cup openings 52 in the lid 50. Each of the game light emitters 58 emits a selectable color of light outwardly through the respective cup 30 opening when the game light emitters 58 are turned on. In this way the plurality of game light emitters 58 illuminate the respective beverage cup 30 and thusly enhance visibility of the respective beverage cup 30 in a darkened environment. The darkened environment may be an outdoor setting at night time or other similar darkened environment. Each of the game light emitters 58 may be a multi color LED or other type of electronic light emitter that is capable of emitting visible light in a plurality of colors.

A game switch 60 is slidably coupled to the box 42 and the game switch 60 is electrically coupled to the plurality of game light emitters 58 for turning the game light emitters 58 on and off. The game switch 60 may be depressed into a selecting position for actuating the plurality of game light emitters 58 to cycle between the selectable colors of light. At least one ball 62 is provided that is thrown toward a selectable one of the cup openings 52 for playing the game of beer pong. The at least one ball 62 is comprised of a phosphorescent material thereby facilitating the at least one ball 62 to glow in the darkened environment. In this way the at least one ball 62 enhances playing the game of beer pong in the darkened environment. The at least one ball 62 may be a glow in the dark ping pong ball or the like.

A plurality of radiation emitters 64 is each coupled to the box 42. The at least one ball 62 is positionable beneath the radiation emitters 64 for absorbing ultra-violet light from the radiation emitters 64. In this way the phosphorescent material of the at least one ball 62 is charged to emit visible light in the darkened environment. The plurality of radiation emitters 64 is positioned on the bottom wall 44 of the box 42 and the plurality of radiation emitters 64 may comprise an ultraviolet light emitter.

A radiation switch 66 is slidably coupled to the box 42 and the radiation switch 66 is electrically coupled to the plurality of radiation emitters 64 for turning the plurality of radiation emitters 64 on and off. A power supply 68 is removably coupled to the box 42, the power supply 68 is electrically coupled to the game switch 60 and the radiation switch 66, and the power supply 68 comprises at least one battery 69. A battery opening 70 may extend through the bottom wall 44 of the box 42 and a battery cover 72 may be coupled to the bottom wall 44 of the box 42 for covering the battery opening 70. The at least one battery 69 may be accessible through the battery opening 70 for changing the at least one battery 69.

In use, the tripod 12 is positioned in the deployed position and the shaft 14 is adjusted to the selected height. The pivot 38 is manipulated to tilt the box 42, if necessary, for leveling the lid 50 on the box 42. Each of the cup openings 52 has the respective beverage cup 30 positioned therein and the game switch 60 is manipulated to turn the game light emitters 58 on. Thus, the beverage cup 30 in each of the cup openings 52 is illuminated for playing beer pong in the darkened environment. The radiation switch 66 is manipulated to turn the radiation emitters 64 on the thusly charge the at least one ball 62 to glow in the dark. Thus, the at least one ball 62 can be thrown at the beverage cup 30*s* according to the rules of the game of beer pong. In this way the game of beer pong can be played in any location, even at night. Additionally, the box 42 and the tripod 12 facilitate the game of beer pong to be played without requiring the use of a table or other similar support surface. In this way the box 42 and the tripod 12 facilitate the game of beer pong to be played in a remote location, such as a camping site or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An illuminated beer pong assembly being configured to facilitate the game of beer pong to be played in a darkened environment, said assembly comprising:

a tripod being positionable between a deployed position and a stored position, said tripod including a shaft being vertically oriented when said tripod is positioned in said deployed position;

a box being pivotally coupled to said shaft, said box being spaceable a selected distance above said tripod when said tripod is positioned in said deployed position thereby elevating said box to a predetermined height;

a lid being hingedly coupled to said box, said lid having a plurality of cup openings each extending therethrough wherein each of said cup openings is configured to receive a respective beverage cup, said cup openings being arranged into a triangular shape wherein said cup openings are configured to arrange the beverage cups into the preferred positioning for the game of beer pong;

a plurality of game light emitters, each of said game light emitters being positioned within said box, each of said game light emitters being aligned with a respective one of said cup openings in said lid, each of said light emitters emitting a selectable color of light outwardly through said respective cup opening wherein said plurality of light emitters is configured to illuminate the respective beverage cup and thusly enhance visibility of the respective beverage cup in a darkened environment;

at least one ball being thrown toward a selectable one of said cup openings wherein said at least one ball is configured for playing the game of beer pong, said at least one ball being comprised of a phosphorescent material thereby facilitating said at least one ball to glow in the darkened environment wherein said at least one ball is configured to enhance playing the game of beer pong in the darkened environment; and a plurality of radiation emitters, each of said radiation emitters being coupled to said box, said at least one ball being positionable beneath said radiation emitters for absorbing ultra-violet light from said radiation emitters wherein said phosphorescent material is configured to emit visible light in the darkened environment.

2. The assembly according to claim 1, further comprising:

said shaft having a first section being slidably coupled to a second section such that said shaft has a telescopically adjustable height, said second section having a distal end with respect to said tripod;

a disk having said shaft extending therethrough, said disk having a plurality of openings extending therethrough wherein each of said openings is configured to receive a respective beverage cup for storing the respective beverage cup, said disk having a first surface, a second surface and a peripheral edge extending therebetween, each of said openings extending through said first and second surfaces, said openings being spaced from said peripheral edge and being distributed around said peripheral edge, said shaft extending through a center of said first and second surfaces, said disk being positioned on said first section of said shaft; and a pivot being coupled to said distal end of said second section of said shaft, said pivot including a coupling being rotatable about a horizontal axis.

3. The assembly according to claim 2, wherein said box has a bottom wall and an outer wall extending upwardly therefrom, said outer wall having a distal edge defining an opening into said box, said bottom wall being coupled to said coupling of said pivot such that said box is tiltable about said horizontal axis.

4. The assembly according to claim 1, further comprising:

a game switch being slidably coupled to said box, said game switch being electrically coupled to said plurality of game light emitters for turning said game light emitters on and off said plurality of radiation emitters being positioned on a bottom wall of said box;

a radiation switch being slidably coupled to said box, said radiation switch being electrically coupled to said plurality of radiation emitters for turning said plurality of radiation emitters on and off; and a power supply being removably coupled to said box, said power supply being electrically coupled to said game switch and said radiation switch, said power supply comprising at least one battery.

5. An illuminated beer pong assembly being configured to facilitate the game of beer pong to be played in a darkened environment, said assembly comprising:

a tripod being positionable between a deployed position and a stored position, said tripod including a shaft being vertically oriented when said tripod is positioned in said deployed position, said shaft having a first section being slidably coupled to a second section such that said shaft has a telescopically adjustable height, said second section having a distal end with respect to said tripod;

a disk having said shaft extending therethrough, said disk having a plurality of openings extending therethrough wherein each of said openings is configured to receive a respective beverage cup for storing the respective beverage cup, said disk having a first surface, a second surface and a peripheral edge extending therebetween, each of said openings extending through said first and second surfaces, said openings being spaced from said peripheral edge and being distributed around said peripheral edge, said shaft extending through a center of said first and second surfaces, said disk being positioned on said first section of said shaft;

a pivot being coupled to said distal end of said second section of said shaft, said pivot including a coupling being rotatable about a horizontal axis;

a box being pivotally coupled to said shaft, said box being spaceable a selected distance above said tripod when said tripod is positioned in said deployed position thereby elevating said box to a predetermined height, said box having a bottom wall and an outer wall extending upwardly therefrom, said outer wall having a distal edge defining an opening into said box, said bottom wall being coupled to said coupling of said pivot such that said box is tiltable about said horizontal axis;

a lid being hingedly coupled to said box, said lid having a plurality of cup openings each extending therethrough wherein each of said cup openings is configured to receive a respective beverage cup, said cup openings being arranged into a triangular shape wherein said cup openings are configured to arrange the beverage cups into the preferred positioning for the game of beer pong, said lid having top surface and a bottom surface, each of said cup openings extending through said top and bottom surfaces, said bottom surface abutting said distal edge of said outer wall of said box when said lid is closed;

a plurality of game light emitters, each of said game light emitters being positioned within said box, each of said game light emitters being aligned with a respective one of said cup openings in said lid, each of said light emitters emitting a selectable color of light outwardly through said respective cup opening wherein said plurality of light emitters is configured to illuminate the respective beverage cup and thusly enhance visibility of the respective beverage cup in a darkened environment;

a game switch being slidably coupled to said box, said game switch being electrically coupled to said plurality of game light emitters for turning said game light emitters on and off;

at least one ball being thrown toward a selectable one of said cup openings wherein said at least one ball is configured for playing the game of beer pong, said at least one ball being comprised of a phosphorescent material thereby facilitating said at least one ball to glow in the darkened environment wherein said at least one ball is configured to enhance playing the game of beer pong in the darkened environment;

a plurality of radiation emitters, each of said radiation emitters being coupled to said box, said at least one ball being positionable beneath said radiation emitters for absorbing ultra-violet light from said radiation emitters wherein said phosphorescent material is configured to emit visible light in the darkened environment, said plurality of radiation emitters being positioned on said bottom wall of said box;

a radiation switch being slidably coupled to said box, said radiation switch being electrically coupled to said plurality of radiation emitters for turning said plurality of radiation emitters on and off; and a power supply being removably coupled to said box, said power supply being electrically coupled to said game switch and said radiation switch, said power supply comprising at least one battery.

* * * * *